US012638025B2

(12) United States Patent
Yazici et al.

(10) Patent No.: US 12,638,025 B2
(45) Date of Patent: May 26, 2026

(54) SLIDABLE LINERS IN SWIRL RECOVERY VANE STRUCTURE

(71) Applicant: RTX Corporation, Farmington, CT (US)

(72) Inventors: Murat Yazici, Glastonbury, CT (US); Andrew E. Breault, Bolton, CT (US); Jeffrey T. Morton, Manchester, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 18/933,563

(22) Filed: Oct. 31, 2024

(65) Prior Publication Data

US 2026/0117800 A1 Apr. 30, 2026

(51) Int. Cl.
*F04D 29/66* (2006.01)
*F04D 29/54* (2006.01)

(52) U.S. Cl.
CPC ..... *F04D 29/664* (2013.01); *F04D 29/542* (2013.01)

(58) Field of Classification Search
CPC ..... F04D 29/664; F04D 29/542; F05D 2250/191; F05D 2250/75; F01D 9/02; F01D 25/04; F02K 1/827; F02C 7/24; G10K 11/172
See application file for complete search history.

(56) References Cited

U.S. PATENT DOCUMENTS 2,925,231 A 2/1960 Pfaff
3,796,513 A 3/1974 Jonas
4,720,239 A 1/1988 Owczarek
5,498,137 A 3/1996 El-Aini
5,626,462 A 5/1997 Jackson
5,634,771 A 6/1997 Howard
5,655,883 A 8/1997 Schilling
(Continued)

FOREIGN PATENT DOCUMENTS

EP 4303124 A1 * 1/2024 ..... B64C 29/0033
GB 2361035 A 10/2001
(Continued)

OTHER PUBLICATIONS

Extended European Search Report for counterpart EP Application No. 25212045.6 dated Mar. 26, 2026.
(Continued)

*Primary Examiner* — Chelsea E Stinson
*Assistant Examiner* — Eric A Lange
(74) *Attorney, Agent, or Firm* — Bachman & LaPointe, P.C.

(57) ABSTRACT

A swirl recovery vane with acoustic treatment including a leading edge and a trailing edge opposite chordwise from the leading edge; an attachment region opposite spanwise from a tip region; a span dimension extending between the attachment region and the tip region; a chord dimension extending between the leading edge and the trailing edge; a pressure side opposite a suction side of the swirl recovery vane; an acoustic panel receiver formed within the swirl recovery vane extending at least one of spanwise through the swirl recovery vane between the attachment region and the tip region or chordwise between the leading edge and the trailing edge; and an acoustic panel inserted into the acoustic panel receiver.

12 Claims, 2 Drawing Sheets

(56) References Cited

U.S. PATENT DOCUMENTS

| | | | |
|---|---|---|---|
| 5,839,882 | A | 11/1998 | Finn |
| 6,039,542 | A | 3/2000 | Schilling |
| 6,287,080 | B1 | 9/2001 | Evans |
| 6,364,616 | B1 | 4/2002 | Stevenson |
| 6,454,536 | B1 | 9/2002 | Evans |
| 6,947,688 | B2 | 9/2005 | Inoue |
| 7,334,998 | B2 | 2/2008 | Jones |
| 7,607,287 | B2 | 10/2009 | Reba |
| 8,333,552 | B2 | 12/2012 | Wood |
| 8,585,368 | B2 | 11/2013 | Viens |
| 8,944,773 | B2 | 2/2015 | Weisse |
| 8,973,364 | B2 | 3/2015 | Gilson |
| 9,169,731 | B2 | 10/2015 | Hui |
| 9,453,418 | B2 | 9/2016 | Hui |
| 9,957,824 | B2 | 5/2018 | Klinetob |
| 10,107,191 | B2 | 10/2018 | Gilson |
| 10,655,538 | B2 | 5/2020 | Gilson |
| 11,199,107 | B2 | 12/2021 | Reba |
| 11,408,349 | B2 | 8/2022 | Sawyers-Abbott et al. |
| 11,512,608 | B2 | 11/2022 | Sawyer |
| 11,566,564 | B2 | 1/2023 | Bifulco et al. |
| 11,713,686 | B2 | 8/2023 | Taylor et al. |
| 11,719,110 | B2 | 8/2023 | Villaro Amurrio |
| 2006/0104819 | A1 | 5/2006 | Jones |
| 2008/0295518 | A1* | 12/2008 | Reba ..... F02C 7/24 60/725 |
| 2012/0168248 | A1* | 7/2012 | Burak ..... F01D 9/041 181/292 |
| 2013/0219922 | A1 | 8/2013 | Gilson |
| 2021/0108957 | A1 | 4/2021 | Ostdiek et al. |
| 2021/0317753 | A1 | 10/2021 | Reba |
| 2022/0049621 | A1 | 2/2022 | Sawyers-Abbott |
| 2022/0049656 | A1 | 2/2022 | Sawyers-Abbott |
| 2023/0249810 | A1* | 8/2023 | Ramakrishnan ..... B64C 27/463 416/223 R |
| 2023/0313687 | A1 | 10/2023 | Chinta et al. |
| 2024/0240571 | A1* | 7/2024 | Wood ..... F01D 9/041 |

FOREIGN PATENT DOCUMENTS

| | | | |
|---|---|---|---|
| GB | 2471845 | A | 1/2011 |
| WO | 202300707098 | A1 | 7/2022 |
| WO | WO-2024213858 | A1 * | 10/2024 |

OTHER PUBLICATIONS

Extended European Search Report for counterpart EP Application No. 25212042.3 dated Mar. 11, 2026.

Non Final Office Action for related U.S. Appl. No. 18/933,287, dated Feb. 27, 2026.

* cited by examiner

SLIDABLE LINERS IN SWIRL RECOVERY VANE STRUCTURE

BACKGROUND

The present disclosure is directed to the improved interchangeable acoustic strips and panels for a swirl recovery vane structure.

The swirl recovery vane pattern is defined to meet structural, performance and acoustic requirements across a wide range of operating conditions. Engine noise is challenging for open rotor architectures. Engine and airframe makers are looking for more opportunities for noise reduction. At the engine side, acoustic treatable areas are limited. Swirl recovery vanes are an area for noise reduction opportunities.

SUMMARY

In accordance with the present disclosure, there is provided a swirl recovery vane with acoustic treatment comprising a leading edge and a trailing edge opposite chordwise from the leading edge; an attachment region opposite spanwise from a tip region; a span dimension extending between the attachment region and the tip region; a chord dimension extending between the leading edge and the trailing edge; a pressure side opposite a suction side of the swirl recovery vane; an acoustic panel receiver formed within the swirl recovery vane extending at least one of spanwise through the swirl recovery vane between the attachment region and the tip region or chordwise between the leading edge and the trailing edge; and an acoustic panel inserted into the acoustic panel receiver.

A further embodiment of any of the foregoing embodiments may additionally and/or alternatively include the acoustic panel receiver is formed in the swirl recovery vane at predetermined locations along the span of the swirl recovery vane.

A further embodiment of any of the foregoing embodiments may additionally and/or alternatively include the acoustic panel receiver is located on the pressure side of the swirl recovery vane.

A further embodiment of any of the foregoing embodiments may additionally and/or alternatively include the acoustic panel receiver comprises at least one of a rectangular cross section, an oval cross section, or a tee shaped cross section.

A further embodiment of any of the foregoing embodiments may additionally and/or alternatively include the swirl recovery vane with acoustic treatment further comprising the acoustic treatment formed within the acoustic panel, the acoustic treatment configured to dissipate sound energy.

A further embodiment of any of the foregoing embodiments may additionally and/or alternatively include the acoustic panel is configured slidable into the acoustic panel receiver.

A further embodiment of any of the foregoing embodiments may additionally and/or alternatively include the acoustic panel is configured interchangeable to accommodate design changes and/or damage to the acoustic panel.

In accordance with the present disclosure, there is provided a gas turbine engine with a swirl recovery vane with acoustic treatment comprising a propulsor rotor located within an open environment; an array of swirl recovery vanes downstream from the propulsor rotor, the array of swirl recovery vanes attached to a nacelle flow surface; wherein each swirl recovery vane of the array of swirl recovery vanes comprises a leading edge and a trailing edge opposite chordwise from the leading edge; an attachment region opposite spanwise from a tip region; a span dimension extending between the attachment region and the tip region; a chord dimension extending between the leading edge and the trailing edge; a pressure side opposite a suction side of the swirl recovery vane; an acoustic panel receiver formed within the swirl recovery vane at least one of spanwise through the swirl recovery vane between the attachment region and the tip region or chordwise between the leading edge and the trailing edge; and an acoustic panel inserted into the acoustic panel receiver.

A further embodiment of any of the foregoing embodiments may additionally and/or alternatively include the acoustic panel receiver is one of at least two acoustic panel receivers formed in the swirl recovery vane at predetermined locations along the span of the swirl recovery vane.

A further embodiment of any of the foregoing embodiments may additionally and/or alternatively include the gas turbine engine with a swirl recovery vane with acoustic treatment further comprising the acoustic treatment formed within the acoustic panel, the acoustic treatment configured to dissipate sound energy.

A further embodiment of any of the foregoing embodiments may additionally and/or alternatively include the acoustic panel receiver is located on the pressure side of the swirl recovery vane.

A further embodiment of any of the foregoing embodiments may additionally and/or alternatively include the acoustic panel receiver comprises at least one of a rectangular cross section, an oval cross section, a tee shaped cross section.

A further embodiment of any of the foregoing embodiments may additionally and/or alternatively include the acoustic panel is configured slidable into the acoustic panel receiver.

In accordance with the present disclosure, there is provided a process for a swirl recovery vane with acoustic treatment comprising locating a propulsor rotor in an open environment; supporting an array of swirl recovery vanes downstream from the propulsor rotor; attaching the array of swirl recovery vanes to a nacelle flow surface by coupling an attachment region of a swirl recovery vane of the array of swirl recovery vanes in operative communication with the nacelle flow surface; forming an acoustic panel receiver within the swirl recovery vane extending at least one of spanwise through the swirl recovery vane between the attachment region and the tip region or chordwise between a leading edge and a trailing edge of the swirl recovery vane; and inserting an acoustic panel into the acoustic panel receiver.

A further embodiment of any of the foregoing embodiments may additionally and/or alternatively include the process further comprising forming the acoustic panel receiver in the swirl recovery vane at predetermined locations along the span of the swirl recovery vane.

A further embodiment of any of the foregoing embodiments may additionally and/or alternatively include the process further comprising forming the acoustic treatment within the acoustic panel; and configuring the acoustic treatment to dissipate sound energy.

A further embodiment of any of the foregoing embodiments may additionally and/or alternatively include the process further comprising locating the acoustic panel receiver on the pressure side of the swirl recovery vane.

A further embodiment of any of the foregoing embodiments may additionally and/or alternatively include the process further comprising configuring the acoustic panel slidable into the acoustic panel receiver.

A further embodiment of any of the foregoing embodiments may additionally and/or alternatively include the process further comprising configuring the acoustic panel interchangeable to accommodate design changes and/or damage to the acoustic panel.

A further embodiment of any of the foregoing embodiments may additionally and/or alternatively include the process further comprising shaping the acoustic panel to influence acoustic dampening capability in the proximity of the swirl recovery vane.

Other details of the interchangeable acoustic strips and panels for swirl recovery vane structure are set forth in the following detailed description and the accompanying drawings wherein like reference numerals depict like elements.

DETAILED DESCRIPTION

Figure 1:
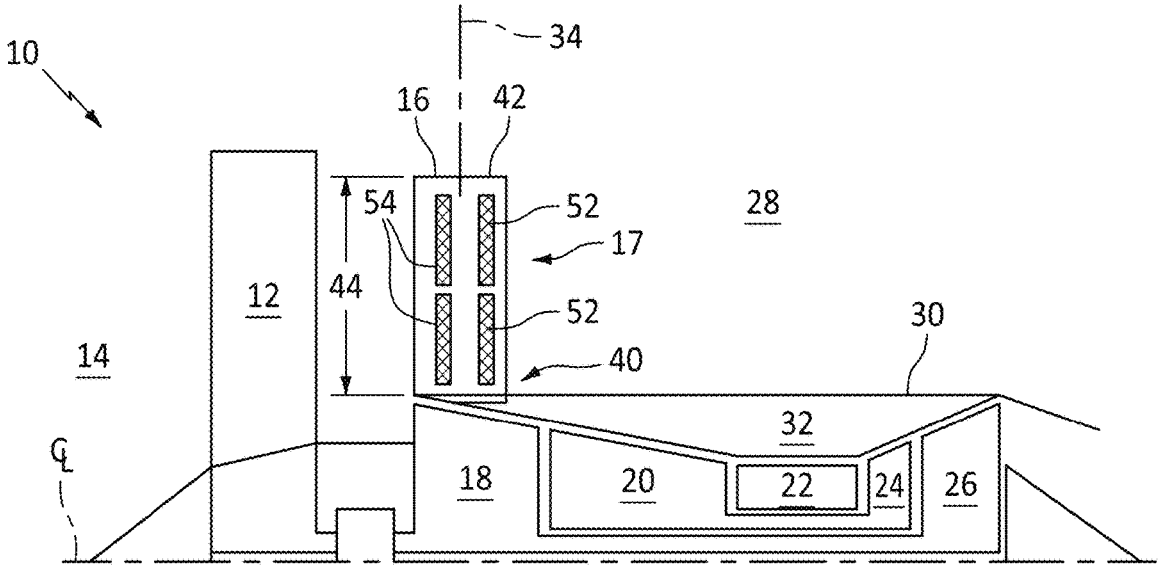
FIG. 1 is a schematic representation of a gas turbine engine with an unducted rotor exposed to an open environment.

Referring now to FIG. 1 showing a schematic of a gas turbine engine 10. The gas turbine engine 10 includes a propulsor rotor 12 proximate an engine inlet 14. An open rotor core gas generator inlet may be as shown or reversed as in a reverse flow configuration (e.g., inlet for the core located at a downstream end of the gas turbine engine 10 to support a reverse core). Though not depicted as an inlet for air entering the core, one skilled in the art understands that an engine inlet enables a flow of core air into the gas turbine engine 10. Downstream from the propulsor rotor 12 is a swirl recovery vane 16. The gas turbine engine 10 can be an open rotor engine centered about centerline CL. The swirl recovery vanes 16 can be arranged as an array 17 configured about the centerline CL or another centerline. The gas turbine engine 10 includes sections listed from forward toward aft, such as, a low pressure compressor (LPC) 18, high pressure compressor (HPC) 20, combustor (COMB) 22, high pressure turbine (HPT) 24, and low pressure turbine (LPT) 26. The orientation of sections 18-26 may be arranged in a different orientation from what is shown in FIG. 1, such as in a reverse core orientation (not shown) with a reversed engine inlet 14. An open environment 28 is exterior to a nacelle flow surface 30.

The nacelle flow surface 30 is shown bounding a core compartment 32. The core compartment 32 encloses the above listed gas turbine engine 10 sections. The gas turbine engine 10 can include various propulsion system architectures including a tractor (propulsor rotor and swirl recovery vane at an upstream end of the propulsion system) and a pusher (propulsor rotor and swirl recovery vane at a downstream end of the propulsion system) architectures. In a pusher architecture, the swirl recovery vanes 16 in an optional embodiment may be upstream of the propulsor rotor 12 and may act to pre-swirl the air rather than recover swirl.

The swirl recovery vane 16 extends into the open environment 28. The swirl recovery vane 16 is in operative communication with the nacelle flow surface 30. The swirl recovery vane 16 includes a vane stacking axis 34 that is largely radially aligned with respect to the centerline CL. The swirl recovery vane 16 can be a cantilever supported structure. In an exemplary embodiment, the swirl recovery vane 16 can have a variable pitch.

Figure 2:
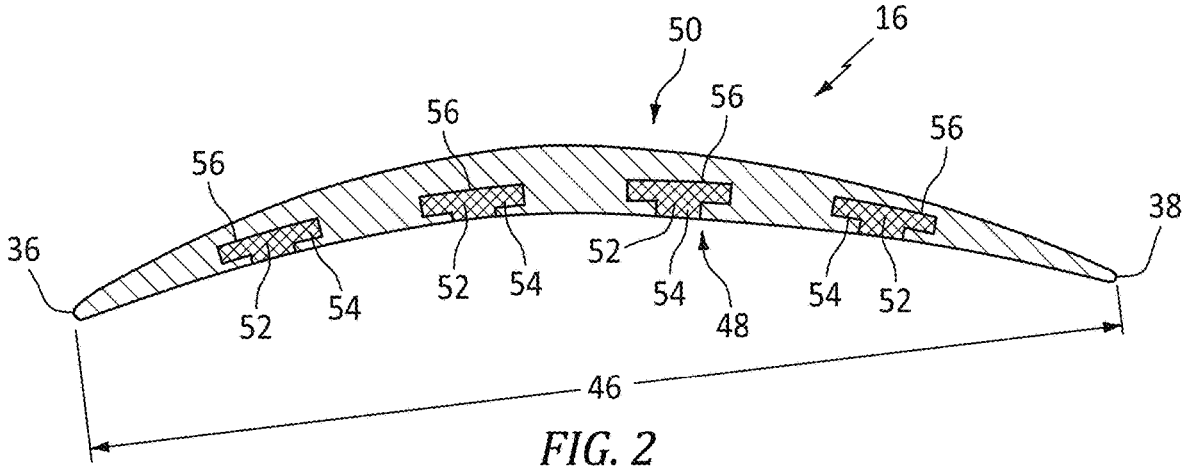
FIG. 2 is a sectional view of schematic representation of the exemplary swirl recovery vane with acoustic treatment.

With reference also to FIG. 2, the swirl recovery vane 16 includes a leading edge 36 and a trailing edge 38 opposite chordwise from the leading edge 36. The swirl recovery vane 16 includes a pressure side 48 and a suction side 50.

The swirl recovery vane 16 includes an attachment region 40 proximate the nacelle flow surface 30. The attachment region 40 of the swirl recovery vane 16 attaches to the nacelle flow surface 30 or a variable pitch mechanism contained within the nacelle flow surface 30 (not shown in the figures). The swirl recovery vane 16 includes a tip region 42 opposite the attachment region 40.

The swirl recovery vane 16 includes a span 44 dimension extending between the attachment region 40 and the tip region 42. The swirl recovery vane 16 includes a chord dimension 46 extending between the leading edge 36 and the trailing edge 38, as seen in FIG. 2. The swirl recovery vane 16 can include a pressure side 48 and a suction side 50 opposite the pressure side 48.

The swirl recovery vane 16 shown in FIG. 1 is oriented generally vertical, that is along a radial direction, that follows the vane stacking axis 34 relative to the centerline CL axis of the array 17 or can include a canted orientation. In an exemplary embodiment, the vane stacking axis can be canted aft, that is the attachment region 40 is forward of the tip region 42.

The swirl recovery vane 16 can include an acoustic treatment 52. The acoustic treatment 52 can be any material or structure configured to dissipate sound energy. The acoustic treatment 52 can include various materials and/or structures with sound-absorbing and diffusing properties. In an exemplary embodiment the acoustic treatment 52 can provide a broadband noise benefit from about 1 to 5 EPNdB. The acoustic treatment 52 can be varied from one swirl recovery vane 16 to another. The variation can be by varying the materials, the shape and the location of the acoustic treatment 52 on each swirl recovery vane 16 in the array 17. The materials of the acoustic treatment 52 can include, but are not limited to composites, metals, plastics, foams, and the like. The acoustic treatment 52 is porous and/or shaped in a form that includes a plurality of cavities with a high surface area to fill ratio (e.g., many nooks and crannies) to enable the acoustic energy to enter and dissipate within. That is, the acoustic panel 54 can be shaped to influence the acoustic dampening capability thereof. For example, the material may include a honeycomb structure, which enables significant acoustic dampening.

Figure 3:
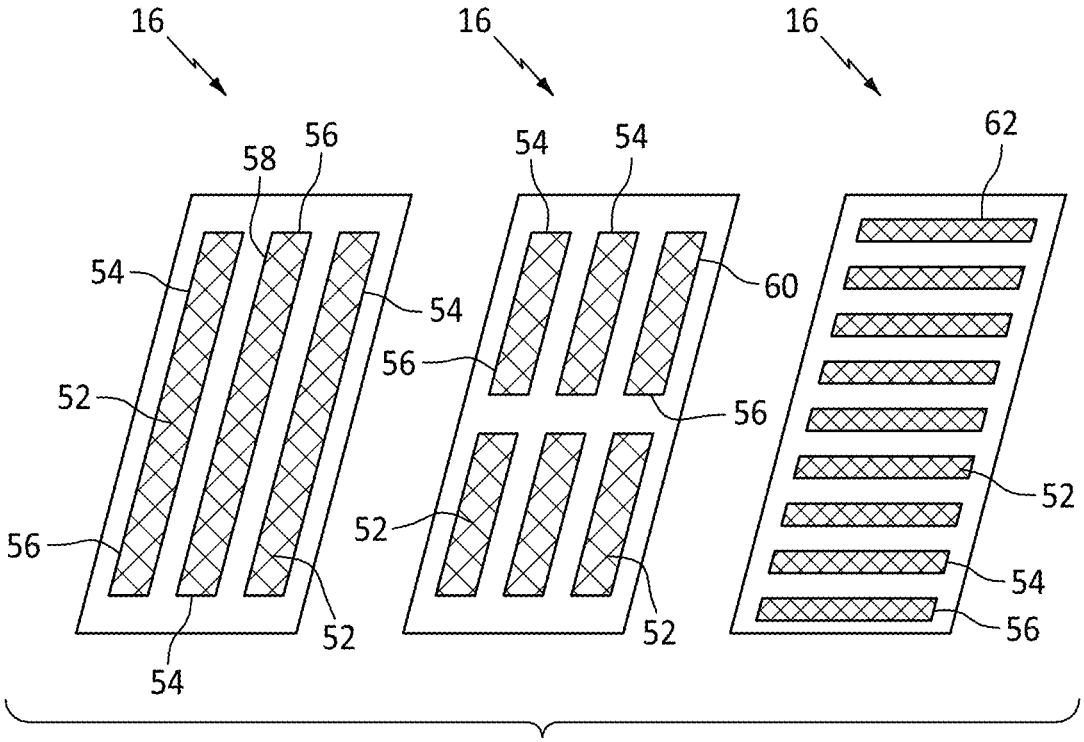
FIG. 3 is a schematic representation of exemplary swirl recovery vanes with acoustic treatment.

The acoustic treatment 52 can be formed as acoustic panels 54 having the cross section and/or shape configured to be inserted into acoustic panel receivers 56 as seen in cross section at FIG. 2. The acoustic panel receiver 56 can have a cross section and/or shape that allows for securing the acoustic panel 54 as well as allowing for insertion of the acoustic panel 54 into the acoustic panel receiver 56. The acoustic panel receiver 56 can have a rectangular cross section and/or shape, oval cross section and/or shape, tee shaped cross section and/or shape and the like (e.g., different shapes, combinations of shapes, etc.). The acoustic panel receivers 56 can be formed in the swirl recovery vane 16 at predetermined locations along the span 44 of the swirl recovery vane 16 as seen in FIG. 3. The acoustic panel receiver 56 can be formed on the pressure side and/or the suction side of the fan exit guide vane 18. The acoustic panel receiver 56 can be aligned along the span 44 as long sections 58 and/or short sections 60, or combinations thereof. The acoustic panel receiver 56 can be aligned chordwise as chord sections 62 shown in FIG. 3. The terms long section 58 and short section 60 are defined relative to the dimensions of the swirl recovery vane 16, such as long section 58 being more than half the span dimension 44 and short section 60 being less than half the span dimension 44. The chord section 62 dimension is relative to the chord dimension 46 and can vary depending on the swirl recovery vane 16. Though illustrated as being of similar orientations on a single swirl recovery vane 16, this is not intending to be so limiting and a single swirl recovery vane 16 may include one or more long sections 58, one or more short sections 60 and/or one or more chord sections 62.

The acoustic panel 54 can be configured to be inserted into the acoustic panel receivers 56. The acoustic panel 54 is configured to be slidable and insertable as a snap fit or friction fit into the acoustic panel receiver 56. The slidable nature is configured so that the panel 54 would slide in from one end of the receiver 56 (during fabrication of the swirl recovery vane 16) and would be trapped by the geometry of the receiver 56. The acoustic panel 54 can be installed into the acoustic panel receiver 56 from the attachment region 40, and/or tip region 42, leading edge 36 and/or trailing edge 38 and/or mid-span, and the like. The locations of the acoustic panel receivers 56 can be located dependent on the design of the swirl recovery vane 16 final count/aero design, acoustic and attachment structural requirements. The material of the swirl recovery vane 16 between the receivers 56 can form ribs that provide structure. The orientation (axial vs radial) of these structural features and how they layout will be influenced by the characteristics of the specific design of the swirl recovery vane 16.

The acoustic panel 54 can be interchangeable to accommodate design changes and/or damage to the acoustic panel 54. The acoustic panel 54 can be shaped to influence the acoustic capability in the proximity of the swirl recovery vane 16. For example, the acoustic panel 54 can include a physical shape, depth, width, height, or other dimension that influences the acoustic capability thereof. The acoustic panel 54 can be varied from one swirl recovery vane 16 to another. The variation can be by varying the materials, the shape and the location of the acoustic panel 54. Though illustrated in FIG. 3 as having acoustic panels 54 on a single swirl recovery vane 16 of the same shape and/or size, this is not intended to be so limiting and the acoustic panels 54 on a single swirl recovery vane 16 may include the same or different shapes, sizes, and orientations (e.g., one or more oriented chordwise, one or more oriented spanwise). The material, shape, and location of the acoustic panels 54 may also vary between swirl recovery vanes 16.

A technical advantage of the disclosed interchangeable acoustic strips and panels for swirl recovery vane structure includes a capacity to dampen acoustic noise along the surfaces of the swirl recovery vane.

Another technical advantage of the disclosed interchangeable acoustic strips and panels for swirl recovery vane structure includes structural features formed in the swirl recovery vane configured to receive acoustic panels.

Another technical advantage of the disclosed interchangeable acoustic strips and panels for swirl recovery vane structure includes interchangeable panels with acoustic treatment.

Another technical advantage of the disclosed interchangeable acoustic strips and panels for swirl recovery vane structure includes patterns of acoustic panels attached to swirl recovery vane enabling both aero and structural function.

There has been provided an interchangeable acoustic strips and panels for swirl recovery vane structure. While the interchangeable acoustic strips and panels for swirl recovery vane structure has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A gas turbine engine with a swirl recovery vane with acoustic treatment comprising:

a propulsor rotor located within an open environment; and an array of swirl recovery vanes downstream from the propulsor rotor, the array of swirl recovery vanes attached to a nacelle flow surface; wherein each swirl recovery vane of the array of swirl recovery vanes comprises:

a leading edge and a trailing edge opposite chordwise from the leading edge; an attachment region opposite spanwise from a tip region; a span dimension extending between the attachment region and the tip region; a chord dimension extending between the leading edge and the trailing edge; a pressure side opposite a suction side of the swirl recovery vane;

an acoustic panel receiver formed within the swirl recovery vane extending at least one of spanwise through the swirl recovery vane between the attachment region and the tip region or chordwise between the leading edge and the trailing edge; and an acoustic panel inserted into the acoustic panel receiver wherein the acoustic panel is configured slidable into the acoustic panel receiver from at least one of the attachment region, the tip region, the leading edge and the trailing edge, the acoustic panel being trapped by geometry of the acoustic panel receiver.

2. The gas turbine engine with a swirl recovery vane with acoustic treatment according to claim 1, wherein the acoustic panel receiver is one of at least two acoustic panel receivers formed in the swirl recovery vane at predetermined locations along the span of the swirl recovery vane.

3. The gas turbine engine with a swirl recovery vane with acoustic treatment according to claim 1, further comprising:

the acoustic treatment formed within the acoustic panel, the acoustic treatment configured to dissipate sound energy.

4. The gas turbine engine with a swirl recovery vane with acoustic treatment according to claim 1, wherein the acoustic panel receiver is located on the pressure side of the swirl recovery vane.

5. The gas turbine engine with a swirl recovery vane with acoustic treatment according to claim 1, wherein the acoustic panel receiver comprises at least one of a rectangular cross section, an oval cross section, or a tee shaped cross section.

6. A process for creating a swirl recovery vane with acoustic treatment comprising:

supporting an array of swirl recovery vanes downstream from a location associated with a propulsor rotor in an open environment;

attaching the array of swirl recovery vanes to a nacelle flow surface by coupling an attachment region of a swirl recovery vane of the array of swirl recovery vanes in operative communication with the nacelle flow surface;

forming an acoustic panel receiver within the swirl recovery vane extending at least one of spanwise through the swirl recovery vane between the attachment region and the tip region or chordwise between a leading edge and a trailing edge of the swirl recovery vane;

wherein the acoustic panel is configured slidable into the acoustic panel receiver from at least one of the attachment region, the tip region, the leading edge and the trailing edge, the acoustic panel being trapped by geometry of the acoustic panel receiver, slidably inserting the acoustic panel into the acoustic panel receiver from at least one of the attachment region, the tip region, the leading edge and the trailing edge;

trapping the acoustic panel by a geometry of the acoustic panel receiver; and inserting an acoustic panel into the acoustic panel receiver.

7. The process of claim 6, further comprising:

forming the acoustic panel receiver in the swirl recovery vane at predetermined locations along the span of the swirl recovery vane.

8. The process of claim 6, further comprising:

forming the acoustic treatment within the acoustic panel; and configuring the acoustic treatment to dissipate sound energy.

9. The process of claim 6, further comprising:

locating the acoustic panel receiver on the pressure side of the swirl recovery vane.

10. The process of claim 6, further comprising:

configuring the acoustic panel slidable into the acoustic panel receiver.

11. The process of claim 6, further comprising:

configuring the acoustic panel interchangeable to accommodate design changes and/or damage to the acoustic panel.

12. The process of claim 6, further comprising:

shaping the acoustic panel to influence acoustic dampening capability in the proximity of the swirl recovery vane.

* * * * *